US005473298A

United States Patent [19]

Teutsch

[11] Patent Number: 5,473,298

[45] Date of Patent: Dec. 5, 1995

[54] TORQUE MOTOR

[75] Inventor: Hansklaus Teutsch, Boeblingen, Germany

[73] Assignee: Moog Inc., East Aurora, N.Y.

[21] Appl. No.: 123,537

[22] Filed: Sep. 17, 1993

[30] Foreign Application Priority Data

Sep. 18, 1992 [EP] European Pat. Off. ..... 92116037

[51] Int. Cl.[6] ..... H01F 7/08

[52] U.S. Cl. ..... 335/237; 335/229; 335/258; 335/262; 335/273; 335/274; 335/275

[58] Field of Search ..... 335/229–234, 335/258–276; 251/129.01–129.22

[56] References Cited

U.S. PATENT DOCUMENTS

| | | | |
|---|---|---|---|
| 1,825,482 | 9/1931 | Sosinski . | |
| 3,203,447 | 8/1965 | Bremner | 335/229 |
| 3,323,090 | 5/1967 | O'Brien | 335/230 |
| 3,435,393 | 3/1969 | Meisel | 335/237 |
| 3,533,032 | 10/1970 | Schmdel et al. | 335/217 |
| 3,571,769 | 3/1971 | Pegram | 335/230 |
| 4,560,969 | 12/1985 | Nicholson | 335/229 |
| 4,682,063 | 7/1987 | Lembke | 310/229 |
| 4,881,054 | 11/1989 | Polgar | 335/230 |

FOREIGN PATENT DOCUMENTS

| | | |
|---|---|---|
| 0375093 | 6/1990 | European Pat. Off. . |
| 1282402 | 10/1964 | Germany . |
| 3207619 | 9/1983 | Germany . |
| 3501836 | 7/1986 | Germany . |

*Primary Examiner*—Leo P. Picard
*Assistant Examiner*—Raymond M. Barrera
*Attorney, Agent, or Firm*—Phillips, Lytle, Hitchcock, Blaine & Huber

[57] ABSTRACT

An improved torque motor includes a supporting body (3) having a U-shaped cross-section and formed of a magnetizable material, includes at least two magnet structures (7, 8) adapted to be mounted on the body, includes first polepieces (10–13) mounted on the magnet structures, and includes an armature (5) mounted for movement in working air gaps (16, 17) between the first polepieces. Permanent magnets (10, 11) are mounted on the first polepieces. A second polepiece is spaced from the armature by the presence of a non-working air gap (21). At least one control coil (20) surrounding the second pole between the magnet structures (7, 8).

14 Claims, 6 Drawing Sheets

TORQUE MOTOR

TECHNICAL FIELD

The present invention relates to torque motors for use in the pilot-stages of electrohydraulic servovalves.

BACKGROUND ART

A torque motor is typically used for operating the pilot stage of a two-stage electrohydraulic servovalve. German Offenlegungsschrift No. 3 501 836 (and corresponding U.S. Pat. No. 4,682,063) discloses a torque motor having an armature which is movably mounted between two opposed pole screws, which are threadedly mounted on a body. The pole screws carry electric control coils for influencing the magnetic field produced by a permanent magnet in the armature chamber. It is regarded as a disadvantage with this type of torque motor that two control coils are needed for moving the armature. First, a control circuit has to be provided for exciting both coils, which results in an increased space requirement. Secondly, this torque motor is made up of many parts, has a complicated structure, and is believed to be unreliable in operation, as the failure of one component may cause a malfunction of the whole system.

DISCLOSURE OF THE INVENTION

The principal object of the present invention to provide an improved torque motor which is of simple structure and reliable in operation.

With parenthetical reference to the corresponding parts, portions or surfaces of one or more of the disclosed embodiments, merely for purposes of illustration and not by way of limitation, the invention, in one aspect, provides an improvement in a torque motor which includes a supporting body (3) optionally formed of a magnetizable material, at least two magnet structure members (7, 8) adapted to be mounted on the body, first pole means (12–13) mounted on the magnet structure members, and an armature (5) mounted for movement in working air gaps (16, 17) between the first pole means. The improvement includes permanent magnets (10, 11) mounted on the first pole means, a second pole means (18) spaced from the armature by the presence of a non-working air gap (21) and connected to said magnet structure members, and at least one control coil (20) surrounding the second pole means between the magnet structures (7, 8).

In another aspect, the invention provides a force motor suitable for use in the pilot stage of an electrohydraulic servovalve. The force motor comprises: an armature (5) formed of a magnetically-permeable material and constrained to move along a line of motion perpendicular to a plane of symmetry from a neutral position, the armature having projected dimensions of length, depth and height, no one of said dimensions being more than twice as large as any other of said dimensions; symmetrical opposed magnetic polepieces (12, 13) formed of magnetically-permeable material, the polepieces having inner end faces arranged parallel to said plane of symmetry and arranged in spaced facing relation to the side surfaces of said armature so as to form two variable-length working air gaps (16, 17) therebetween; the sum of the lengths of said working air gaps remaining constant at all operative positions of said armature relative to said opposed polepieces; each of said opposed polepieces abutting a permanent magnet (10, 11) polarized in the direction of said line of motion so as to form a North pole adjacent one of said armature side surfaces and a South pole adjacent the other of said armature side surfaces; a central polepiece formed of a magnetically-permeable material, arranged in said plane of symmetry, having an end face arranged generally parallel to said line of motion and arranged adjacent to an end surface of said armature so a to form a fixed-length non-working air gap (21) therebetween; magnetic circuit means including a magnetically-permeable material arranged to connect the outer ends of each of said opposed polepieces to the outer end of said central polepiece; an electro-magnetic coil (20) wound around said central polepiece and capable of carrying an electrical current to induce a magnetomotive force to cause magnetic flux to flow through said fixed air gaps, said armature, said variable air gaps, and said magnetic circuit means, such coil-produced flux being superimposed on flux produced by said permanent magnets; whereby the total flux in one of said variable air gaps may be increased and the total flux in the other of said variable air gaps may be decreased so as to produce a net force tending to displace said armature.

According to the invention, the first polepieces, between which the movable armature is held is a spring-centered fashion, are arranged in the torque motor to carry the permanent magnets. The second polepiece is surrounded by at least one control coil, and is spaced from the armature by a fixed air gap. Hence, the structure of the torque motor is very simple. Furthermore, the movement of the armature is controllable with the aid of the inventive arrangement of pole means and control coils in an exact way and at higher frequencies than has been possible with prior art torque motors because the improved armature has a smaller mass than in conventional torque motors. Therefore, valves with an increased dynamic response capability can be controlled with the torque motor constructed in accordance with the invention.

In a preferred embodiment, L-shaped magnetic structure members are arranged to face one another. Each has a vertical leg and a horizontal base. The bases face one another, and are adapted to be secured to a supporting body in a transversely-displaceable manner. The first pole means are mounted on the bases. With this construction, the working air gaps between the first polepieces and the armature are adjustable by selectively displacing the L-shaped members in a transverse direction.

Each base includes at least one vertical through-hole, through which a fastening screw is passed and threaded into engagement with the supporting body. The through-hole has a diameter greater than the diameter of the fastening screw, so that the L-shaped magnet structures can be displaced by the amount of the radial clearance between the through-hole and the fastening screw. With such a construction, a coarse adjustment of the working air gap is facilitated, and a fine adjustment can later be accomplished in an especially simple way.

The upper ends of the two magnet structure members are interconnected via a T-shaped member, so that the bottom face of the vertical center leg of the T-shaped member, which is surrounded by at least one coil, faces the upper surface of the armature. A so-called non-working or fixed air gap is formed between the lower end of the central leg of the T-shaped member and the upper surface of the armature. The non-working air gap permits a free translational movement of the armature between the first polepieces. A closed magnetic circuit, which includes the "T", the two "L's" and the armature, causes an increase in the magnetic field produced by the permanent magnets in the working air gaps. The flux associated with the magnetic field which is electromagnetically produced by the coil on the second polepiece is additionally coupled into said magnetic circuit via the vertical center leg.

The two outer ends of the T-shaped member have vertical through-holes or slots, through which fastening screws are respectively passed and threaded into the magnet structures. These through-holes, in turn, have diameters greater than the diameters of the associated fastening screws. By analogy, with the transverse movability of the L-shaped members, the T-shaped member is also very easily adjustable with this construction, as it is laterally displaceable.

Small shims are provided between the two outer ends of the T-shaped member and the upper ends of the L-shaped members for adjusting the non-working air gap between the central leg lower end face of the T-shaped member and the armature. The T-shaped member can be vertically adjusted by inserting shims of different thickness, such that the length of the non-working air gap can be correspondingly reduced or increased.

The permanent magnets have pole shoes of a magnetizable material on the faces adjacent to the armature. Thus, the pole shoes orient and increase the magnetic field in the working air gap in an advantageous way. The permanent magnets are horizontally magnetized and consist of a material of high magnetic remanence, preferably neodymium iron or samarium cobalt. The first-mentioned alloy, which has a high iron content, can be produced in an inexpensive way and has an especially high magnetic remanence. As a consequence, a permanent magnet with small dimensions can be used in the improved torque motor, resulting in low costs and saving in space.

The bases of the L-shaped members, the permanent magnets and the pole shoes have aligned horizontal tapped holes through which threaded abutment stops pass, and which are movable in a direction perpendicular to the magnet structures. The stops prevent direct contact between the armature and the permanent magnets or pole shoes, which might otherwise cause a "latching" of the armature at maximum deflection. The stops are preferably made of a non-magnetizable material so that there are no field distortions in the working air gap. The horizontal hole through the base of the magnet structures is provided with an internal thread, so that a stop provided with a corresponding external thread can be screwed from the outside into the base. Thus, an adjustment of the stops for setting the necessary stroke of the armature can be made from the outside even after the torque motor has been put into operation. In this way, an especially simple and reliable adjustment of the maximum permissable deflection of the armature is possible.

The vertical center leg of the T-shaped member has an axial through-hole through which a resilient rod is guided, one end of the resilient rod being connected to the armature (FIG. 4). The other end of the resilient rod is fixed by means of an adjustable clamping device to the T-shaped member. This effects an adjustable null setting of the armature. Selection of the stiffness of the rod permits setting the gain and the dynamic response of the torque motor. In a variant form, the other end of the resilient rod is connected to a movable actuating device (FIG. 5). This provides a mechanical control possibility for the torque motor, for instance, in cases where the electromagnetic control becomes inoperative because of a failure.

The armature is supported by two vertical bending beams which are mounted in parallel with one other on the supporting body in the center of the plane of the motion. With this parallel mounting, the pivotal movement of the armature is only possible in the preferred direction.

A control tube, having a jet nozzle at its bottom end, is pressed into the armature. The control tube pivots about a center of rotation defined by the bending support beams and follows the movements of the armature to control the direction of the fluid jet exiting from the nozzle. A flexible pressure tube is connected to the control tube at a point near the center of rotation of the armature so that any resultant torque is very small. The control tube is sealed by means of an O-ring which is positioned approximately in the center of rotation of the armature. The O-ring prevents external leakage of hydraulic fluid, but nevertheless gives the armature sufficient freedom of movement due to its arrangement near the center of rotation of the armature.

Other advantages and details of the invention will become apparent from the following description of the preferred embodiments, taken in conjunction with the attached drawings and the appended claims.

DESCRIPTION OF THE PREFERRED EMBODIMENT(S)

Figure 1:
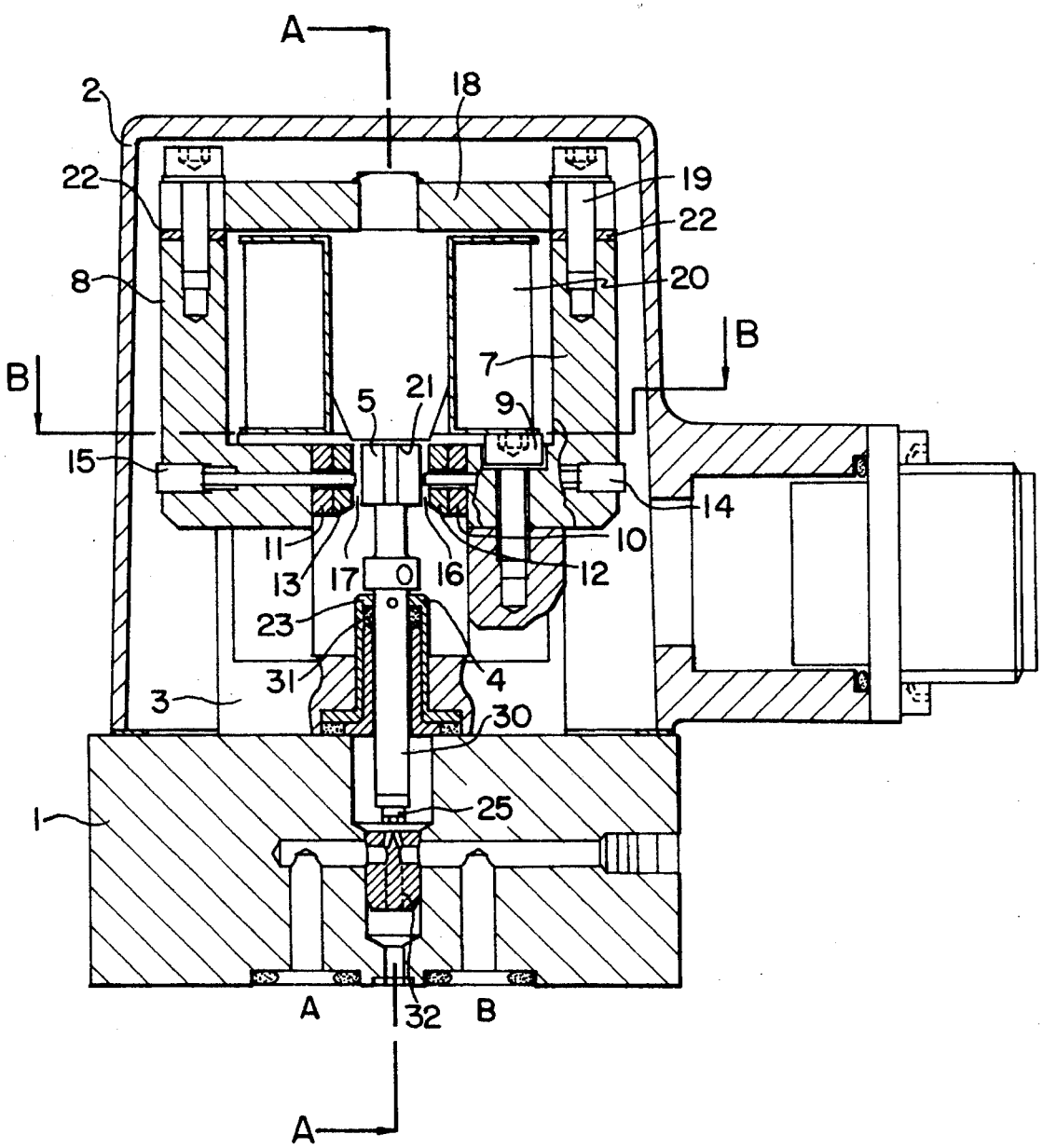
FIG. 1 is a longitudinal vertical sectional through a first embodiment of the improved torque motor.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

First Embodiment (FIGS. 1–3 and 6)

The first embodiment of the improved torque motor will be described with reference to FIGS. 1–3 and 6.

FIG. 1 illustrates the inventive torque motor attached to a hydraulic pilot valve, which includes two hydraulic output ports A, B on its bottom side. The torque motor is surrounded by a housing or cover 2 for protection against dirt and moisture. The torque motor itself is mounted on a supporting body 3 having a round profile, but which appears to be U-shaped longitudinal vertical cross-section. Body 3 has a central through-hole into which a flanged sleeve 4 is fitted. A control tube 30, whose bottom end projects into the servovalves body 1, is passed through the sleeve. The joint between sleeve 4 and control tube 30 is sealed by an O-ring 31.

Control tube 30 has an intermediate portion of enlarged cross-section. An armature 5 is connected to control tube 30, and is substantially block-shaped with faces that are symmetrically beveled towards the center. As is apparent from FIG. 2, the armature is additionally held by two vertical bending beams 6 which are oriented in parallel with each other. It is also possible to provide a thin-walled bending tube as a resilient armature base instead of the parallel bending beams, as is known from the prior art in the case of torque motors.

Adverting to FIG. 1, two L-shaped magnetic members 7, 8 are secured to the supporting body 3 by means of screws 9. One screw 9 is fully shown in FIG. 1 in partly broken lines. The bases of the L-shaped members have vertical through-holes through which a screw 9 is inserted and threaded into engagement with body 3.

Figure 3:
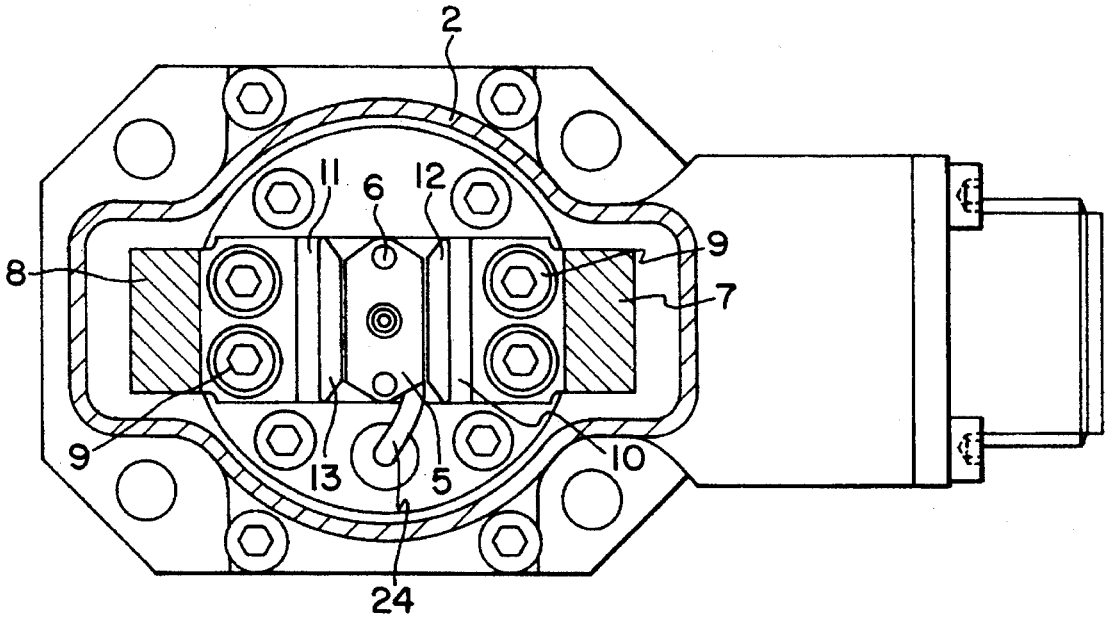
FIG. 3 is a horizontal sectional view thereof, taken generally on line B—B of FIG. 1.

Permanent magnets 10, 11, which face each other, are secured to the facing surfaces of the bases of the L's, for instance, by bonding. The sides of the permanent magnets that face each other, respectively, carry pole shoes 12, 13, with armature 5 being movably mounted between said shoes. Working (i.e., variable-length) air gaps 16, 17 are formed between pole shoes 12, 13 and the respective sides of armature 5. As shown in FIG. 3, the pole shoes have a tapered cross-section at the sides facing the armature, so that the opposing surfaces of the armature and the pole shoes define the air gaps.

The bases of the L-shaped members, the permanent magnets and the pole shoes have aligned horizontal through-holes, a screw-adjustable armature stop being respectively passed therethrough. Stops 14, 15 are made of a non-magnetic material and guided through the aligned horizontal through-holes such that their ends which face the armature project beyond the pole shoes. An external thread, which matches an internal thread formed in an outer area of the bases, is machined into stops 14, 15.

The upper ends of the L-shaped members 7, 8 are interconnected via a T-shaped magnetic member 18. The T-shaped member has vertical slots or through-holes, through which fastening screws 19 are passed. These through-holes in the T-shaped member have, in turn, a slightly greater diameter than the outer diameter of screws 19. One or more control coils 20, whose electric connection lines (not shown) are appropriately guided to the outside, is or are wound around the vertical leg of the T-shaped member. This center leg is of adequate length so that a non-working (i.e., fixed length) air gap 21 is formed between its bottom end and the top surface of the armature. Small shims 22 are inserted between the upper ends of the magnet structures and the T-shaped member to vary the length of the non-working air gap 21.

Figure 2:
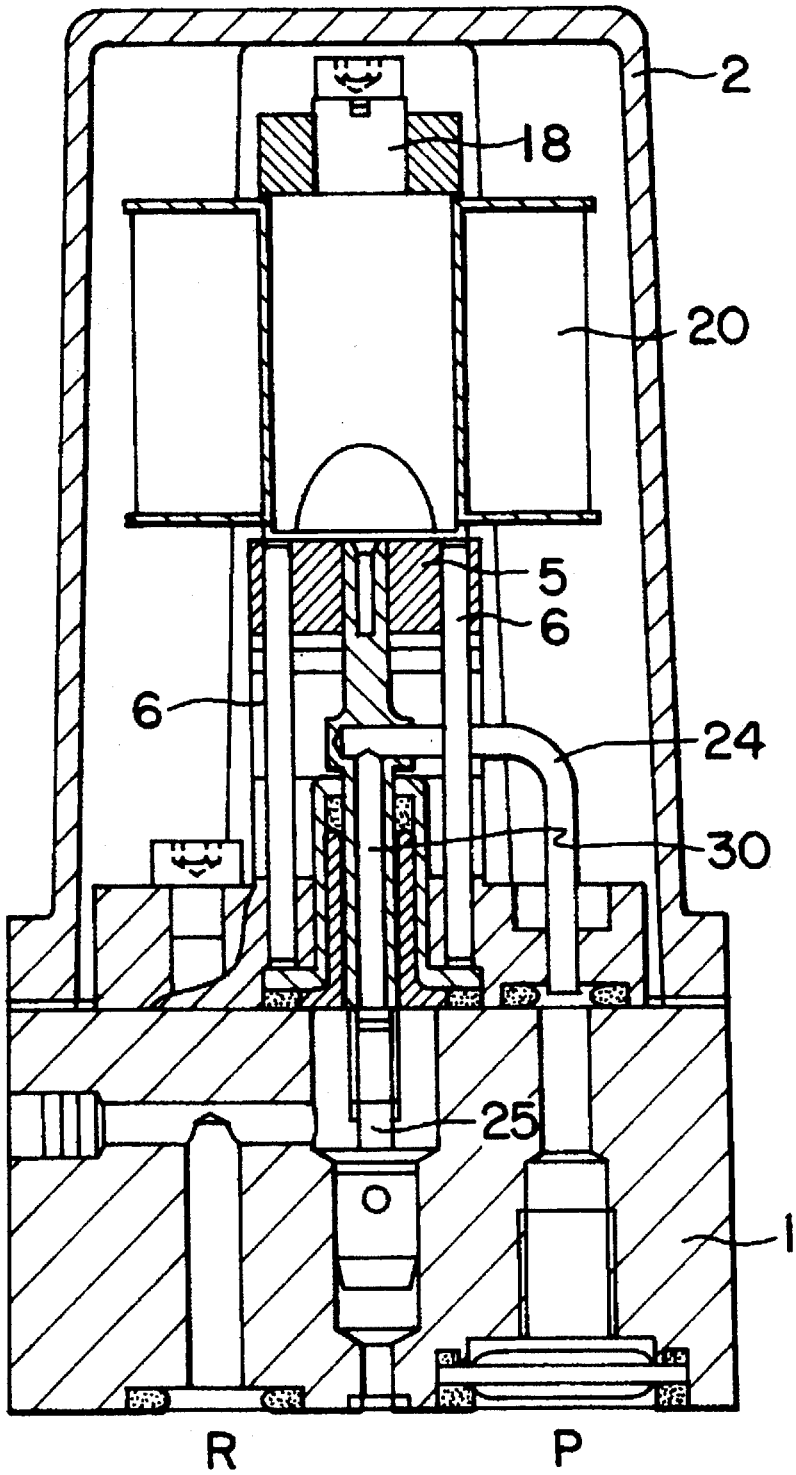
FIG. 2 is a transverse vertical sectional view thereof, taken generally on line A—A of FIG. 1.

As shown in FIG. 2, pilot valve 1 comprises a hydraulic pressure supply connection P and a return connection R. The supply connection P is connected via a flexible pressure line 24 to control tube 30, which is pressed onto armature 5. The connection between the flexible pressure line 24 and the control tube is provided in the central area of control tube 30 which has an enlarged cross-section. At its bottom end control tube 30 has a nozzle 25 through which hydraulic fluid exits. The discharged fluid jet is directed towards a receiver 32 in accordance with jet-pipe principles, which are well-known in the prior art. Control tube 30 is connected in pressure-tight fashion to body 3 via sleeve 4 by means of O-ring 31 which is provided near the center of rotation of the armature.

The operation of the first embodiment of the present invention will now be explained with reference to FIGS. 1–3 and 6.

Figure 6:
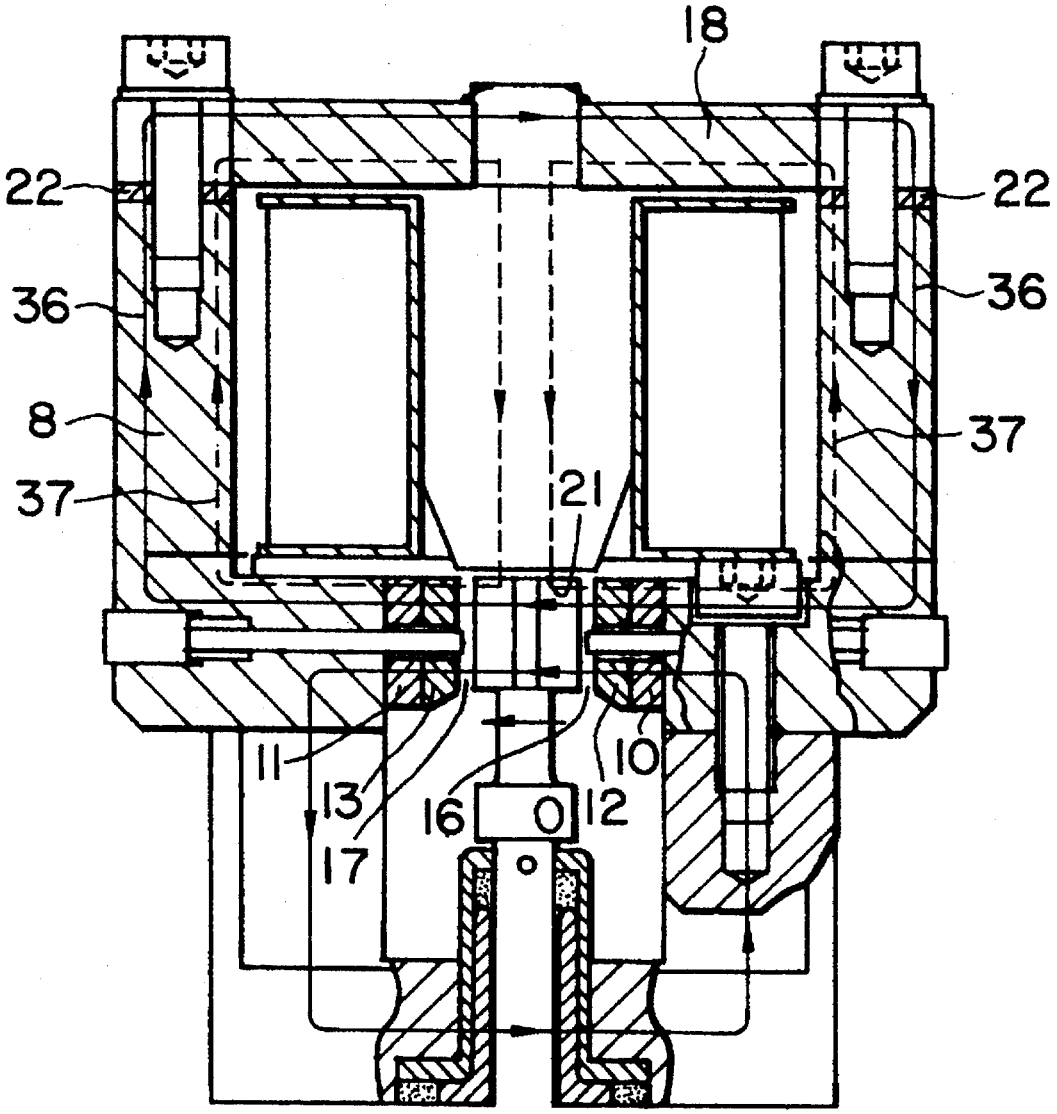
FIG. 6 is a fragmentary enlarged longitudinal vertical sectional of the first form of torque motor, shown in FIG. 1—3, illustrating the magnetic flux paths.

It is initially assumed that the torque motor is in the inoperative state, and that the current in control coil 20 is zero. In this null position, armature 5 is approximately centered between the two pole shoes 12, 13. A magnetic flux path, which is symbolically drawn in continuous lines in FIG. 6, is formed due to the permanent magnets 10, 11, whose arrangement is shown in FIG. 1.

In a magnetic circuit 36 produced by the permanent magnets, the flux lines extend from the North pole of the permanent magnet 11, which is shown in the left half of the figure, via the L-shaped member 8, the T-shaped member 18, the L-shaped member 7 to the South pole of the permanent magnet 10 shown in the right half. Flux lines then extend from the North pole of the permanent magnet 10, which is shown in the right half of the figure, via pole shoe 12, air gap 16, armature 5, air gap 17, pole shoe 13 to the South pole of the permanent magnet 11 shown in the left half of the figure. A permanent-magnetic circuit 35 is closed in a similar way through the body 3. The permanent-magnetic circuit 35 can also be dispensed with if the body is of a non-magnetizable material.

There is a large magneto-motive force (mmf) in the two air gaps 16, 17 because of the magnetic fields created by the two permanent magnets 10, 11. When control coil 20 is not excited, this mmf has the same magnitude in the two air gaps, so that armature 5 assumes a null position because the forces of attraction which act on the armature are about the same in the two working air gaps 16, 17.

When an electric current flows through the control coil 20, a magnetic North pole is thereby formed at the lower end of the vertical leg of the T-shaped member 18, and an opposite South pole at the upper end thereof (or vice versa). As a consequence, the vertical center beam has the function of a coil core for control coil 20. The direction of this electromagnetic field is determined by the direction of the electric current, and induces flux in circuit paths 37, 38.

In a first magnetic circuit 37 which is produced by control coil 20 and shown in FIG. 6 in the left half, the flux lines extend from the magnetic North pole via the non-working air gap 21, armature 5, working air gap 17, pole shoe 13, permanent magnet 11, the L-shaped member 8 and T-shaped member 18 to the South pole of the coil core. In a second magnetic circuit 38 produced by the control coil, which is shown in the right half of FIG. 6, the flux lines extend from the magnetic North pole of the coil core via armature 5, air gap 16, pole shoe 12, permanent magnet 10, the L-shaped member 7 and member 18 to the magnetic South pole of the coil core.

The mmf produced by the permanent magnets is increased in air gap 17 because of the magnetic field created by the control coil. By contrast, the magnetic field in the right half of the figure effects a decrease in mmf, which is excited by the permanent magnet, in air gap 16. The different resultant mmf's create different forces of attraction in air gaps 16 and 17, the resultants of said forces pivoting the armature from its zero position in arrow direction, i.e., to the left. Armature 5 is thus deflected from its zero position in response to the coil current flowing through control coil 20.

Upon deflection of armature 5, the two bending beams 6 produce a restoring force through their elasticity, the restoring force counteracting the magnetic force of attraction.

Therefore, armature 5 is only deflected to such an extent that the magnetic force of attraction is in balance with the restoring force of the bending beams. When the magnetic force of attraction is greater than the restoring force at maximum deflection of the armature, the armature hits the mechanical stop 14 or 15. The stop ensures that the armature does not "latch" to the proximate pole shoe, but immediately returns into its zero position after the coil has been deenergized.

It is obvious to one skilled in the art that an optimum air gap must be adjusted between armature 5 and pole shoes 12, 13 in response to the size of the employed armature 5 and control coil 20. The range of the armature motion and the width of the air gaps 16, 17 can be varied by laterally displacing the L-shaped members while the fastening screws 8, 19 are unscrewed. The range of the armature motion, i.e., the maximum permissible deflection of the armature, can additionally be adjusted via stops 14, 15. The adjustment operation may be performed by rotating the stops in the tapped holes of the L-shaped bases.

The mmf in the working air gaps 16, 17 can be influenced by lateral displacement of the T-shaped member 18 when the coil is not excited. The null position of the armature can be adjusted in this way.

During operation of the torque motor the hydraulic oil supply connection P, which is shown in FIG. 2, is connected to the working pressure line. The pressurized oil is introduced via the flexible pressure tubing 24 into control tube 30 of armature 5 and exits through nozzle 25 at the end of the control tube. The oil jet produced in this way follows the movement of armature 5 as to its direction. An oil jet of varying direction is used for controlling the pressures developed in the receiver 32 of the servovalve. The movement of the armature of the torque motor according to the invention can also control the deflector in a deflector-jet system in a similar way.

Figure 4:
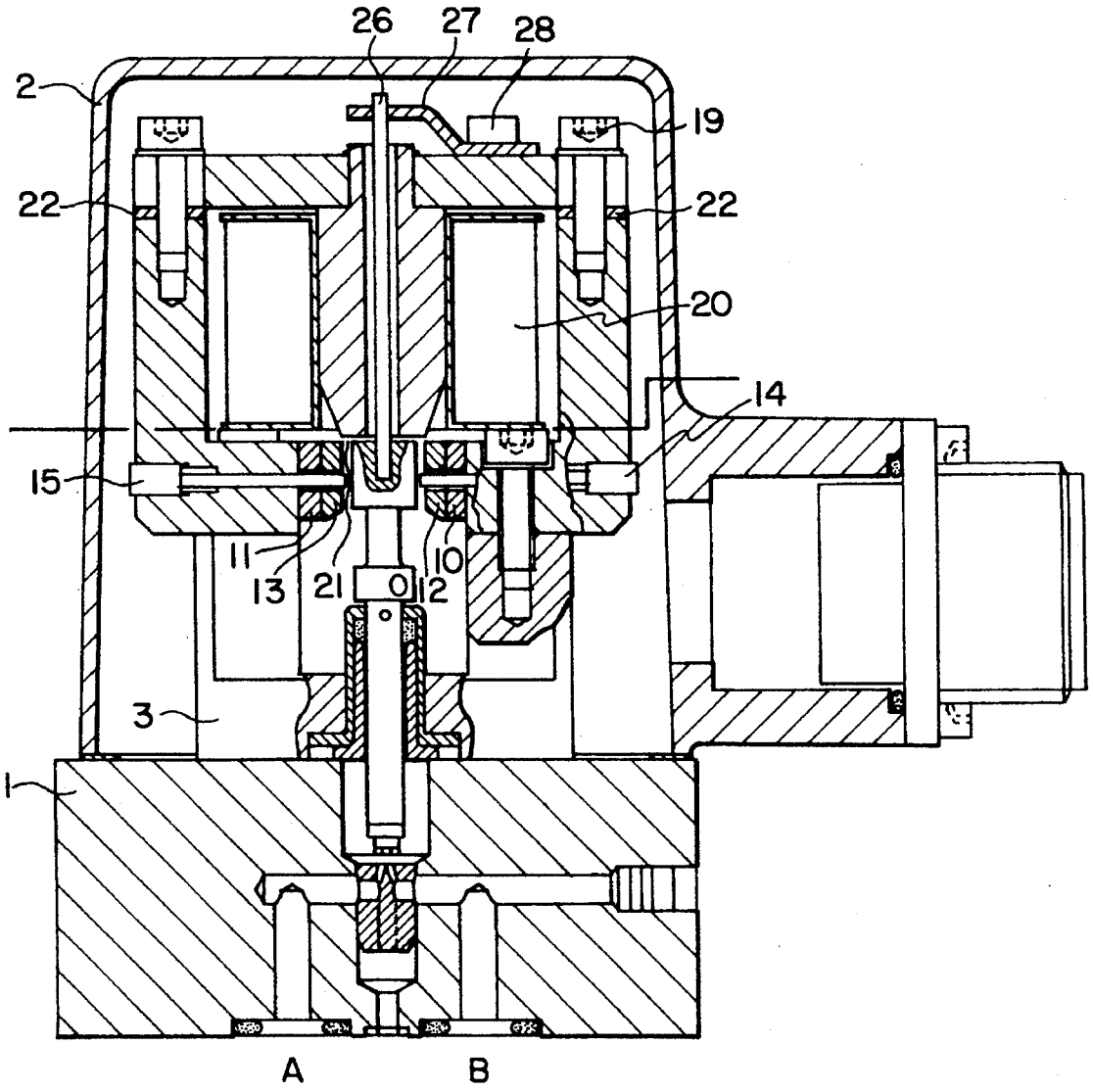
FIG. 4 is a longitudinal vertical sectional through a second embodiment of the improved torque motor.

Second Embodiment (FIG. 4)

A second embodiment of the torque motor of the invention will now be described with reference to FIG. 4. The features of the torque motor which are identical with those of the first embodiment are designated in FIG. 4 with the same reference numerals, and will not be described again.

The second embodiment of the torque motor of the invention substantially differs from the first embodiment by the provision of an additional adjusting possibility for the armature. The vertical center beam of member 18 has a central vertical throughhole, with a resilient rod 26 being passed through the hole. Rod 26 is connected at its lower end to armature 5, e.g., by pressing. The upper end of the resilient rod is clamped by means of a clamping device 27, which is connected via an adjusting screw 28 to member 18. In the central through-hole, the resilient rod has enough play for a movement which is transmitted by the deflection of the armature to the resilient rod.

According to this second embodiment, the restoring force which acts on the deflected armature has two components. The first component is produced by the elastic bending beam 6, as was already the case in the first embodiment. A second component is produced by the elastic resilient rod 26 upon deflection of the armature from the zero position. Since the two components of the restoring force are added, the dynamic response of the armature is increased, i.e., the overall stiffness of the spring-mass system, i.e., the bending-beam armature, is increased and the natural frequency rises accordingly.

Furthermore, the zero position of the armature can be changed or adjusted according to the second embodiment. To this end, the adjusting screw 28 on the T-shaped member is unscrewed and the resilient rod is moved into its desired position. Thereupon, the adjustment is locked by tightening the screw. This additional adjusting possibility for the armature is of advantage in this preferred embodiment.

Figure 5:
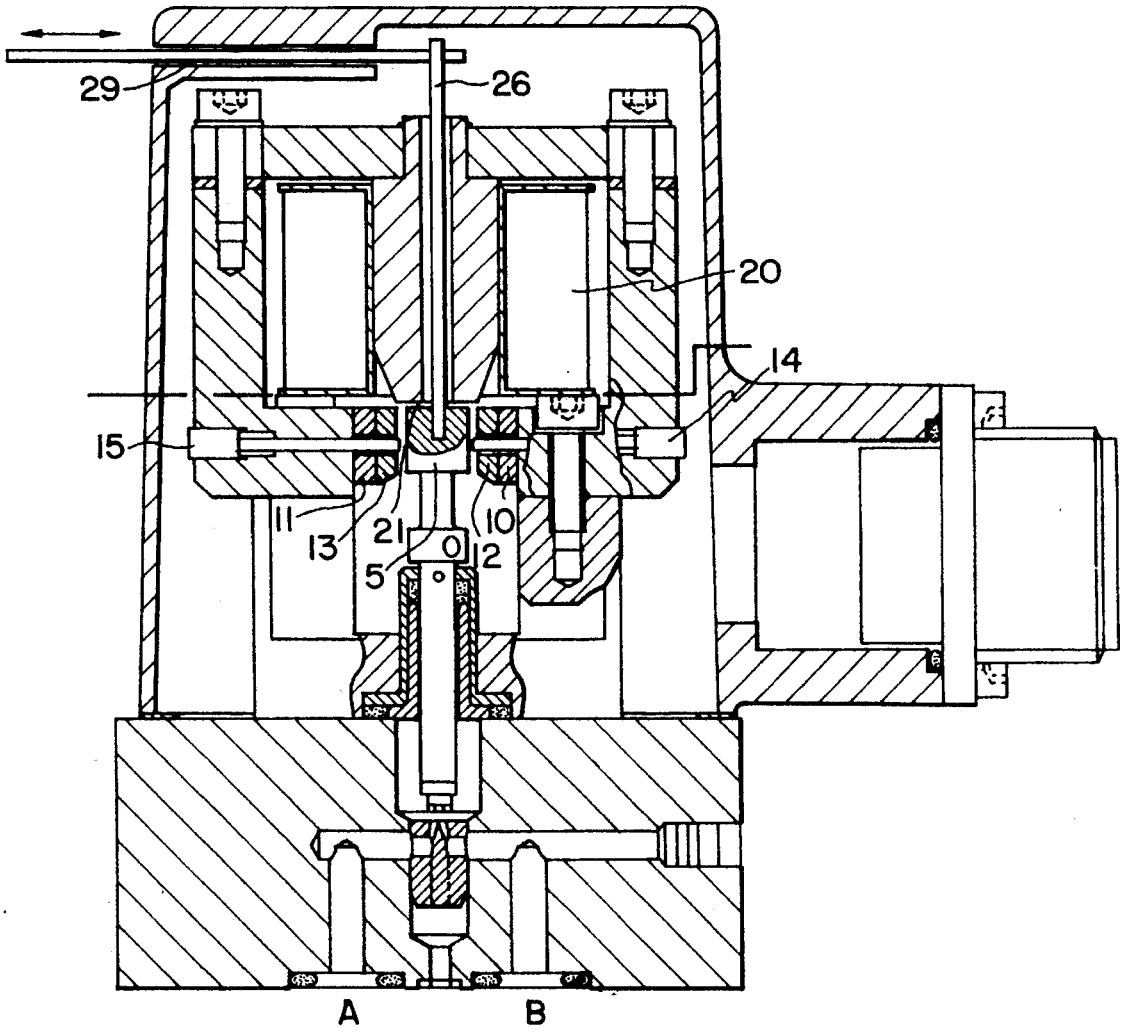
FIG. 5 is a longitudinal vertical sectional through a third embodiment of the improved torque motor.

Third Embodiment (FIG. 5)

A third embodiment of the torque motor of the invention is shown in FIG. 5. The third embodiment differs from the second embodiment such that there is no clamping device for the resilient rod 26, but instead of this an actuating device 29 for mechanically operating the resilient rod 26 is provided. As a consequence, movements of the actuating means 14 are directly transmitted via the resilient rod 26 to the armature 5. Emergency operation which is often demanded and becomes operative in case of failure of the electromagnetic control is implemented in this embodiment. A mechanical feedback can also be realized as an alternative.

Modifications

The present invention contemplates that many changes and modifications may be made. For example the body and polepieces may be formed of different shapes and materials, The jet pipe may be mounted by means of a flexure tube, as shown, or by some other means. The improved torque motor may be mounted on a conventional two-stage electrohydraulic servovalve, such as shown and described in U.S. Pat. No. 3,023,782, the aggregate disclosure of which is hereby incorporated by reference. As previously noted, it is possible to provide a plurality of control coils instead of one control coil. Multiple control coils could also be located around the vertical leg of the L-shaped members, or around the horizontal arms of the T-shaped member.

Therefore, while a preferred form of the improved torque motor has been shown and described, and several modifications thereof discussed, persons skilled in this art will readily appreciate that various additional changes and modifications may be made without departing from the spirit of the invention, as defined and differentiated by the following claims.

What is claimed is:

1. In a force motor adapted to be mounted on a surface of a body, having an armature mounted for movement relative to said body along a line substantially parallel to said surface, having a magnetic structure, said structure having a first polepiece terminating in a first pole face arranged substantially perpendicular to said body and arranged in spaced facing relation to said armature to define a variable-length first working air gap therebetween, having a second polepiece terminating in a second pole face arranged substantially perpendicular to said body surface and arranged in spaced facing relation to said armature to define a variable-length second working air gap therebetween, and having a third polepiece terminating in a third pole face arranged substantially perpendicular to said first and second pole faces and arranged in spaced facing relation to said armature to define a fixed-length non-working air gap therebetween, a coil surrounding said third polepiece, and magnet means arranged in series with said first and second polepieces to oppositely polarize said first and second pole faces, the improvement which comprises:

clamping means operatively arranged between said structure and body for selectively permitting said structure to be slidably moved along said surface to adjust the lengths of said first and second working air gaps.

2. The improvement as set forth in claim 1 wherein said clamping means includes at least one hole provided through said structure, and a fastener adapted to be passed through said structure hole and operatively engaged with said body, the diameter of said fastener being less than the diameter of said structure hole such that said fastener may be selectively loosened to permit said structure to be moved along said body surface and selectively tightened to prevent said structure from being slidably moved along said body surface.

3. The improvement as set forth in claim 2 wherein said magnetic structure includes first and second members, wherein each member is provided with a through-hole, wherein a fastener is adapted to be passed though the associated hole and be engaged with said body such that said fasteners may be selectively loosened to permit said members may be slidably moved along said surface independently of one another, and selectively tightened to prevent said members from being slidably moved along said body surface.

4. The improvement as set forth in clam 3 wherein each of said members is L-shaped and has a base portion terminating in a first end face and has a leg portion extending away from said base portion and terminating in a second end face, wherein said L-shaped members are mounted on said body such that said first end faces are arranged in spaced facing relation to one another, and further comprising a T-shaped member having a cross-bar portion and a depending leg portion, and wherein the opposite marginal end portions of said cross-bar portion are arranged to engage said second end faces.

5. The improvement as set forth in claim 4 wherein said clamping means further includes additional holes extending through said marginal end portions of said cross-bar portion, and additional fasteners passed through said additional holes and operatively engaged with said leg portions, the diameter of each additional fastener being less that the diameter of each associated additional hole such that said additional fasteners may be selectively loosened to permit said cross-bar portions to be moved relative to said leg portion second faces, and may be selectively tightened to prevent said cross-bar portions from being moved relative to said leg portion second faces.

6. The improvement as set forth in claim 1 wherein said structure is rigid.

7. In a force motor adapted to be mounted on a surface of a body, having an armature mounted for movement relative to said body along a line substantially parallel to said surface, having magnetic structure, said structure having a first polepiece terminating in a first pole face arranged substantially perpendicular to said body surface and arranged in spaced facing relation to said armature to define a variable-length first working air gap therebetween, having a second polepiece terminating in a second pole face arranged substantially perpendicular to said body surface and arranged in spaced facing relation to said armature to define a variable-length second working air gap therebetween, and having a third polepiece terminating in a third pole face arranged substantially perpendicular to said first and second pole faces and arranged in spaced facing relation to said armature to define a fixed-length non-working air gap therebetween, a coil surrounding said third polepiece, and magnet means arranged in series with said first and second polepieces to oppositely polarize said first and second pole faces, the improvement which comprises:

adjustment means for enabling the position of said third pole face with respect to said armature to be varied so as to adjust the length of said non-working air gap.

8. The improvement as set forth in claim 7 wherein said structure has two leg portions terminating in end faces, wherein said structure has a T-shaped member having a cross-bar portion and a depending leg portion, wherein the marginal end portions of said cross-bar portion are adapted to be mounted on said leg portion end faces, and wherein said adjustment means includes shims positioned between said marginal end portions and said leg portion end faces.

9. The improvement as set forth in claim 5 wherein a hole is provided through each marginal end portion, and wherein a fastener is passed through each hole and is engaged with the associate leg portion for releasably holding said third pole face in fixed relation to said armature.

10. The improvement as set forth in claim 9 wherein each fastener passes through any shim that is positioned between said the associated marginal end portion and the associated end face.

11. In a force motor adapted to be mounted on a surface of a body, having an armature mounted for movement relative to said body along a line substantially parallel to said surface, having a magnetic structure, said structure having a first polepiece terminating in a first pole face arranged substantially perpendicular to said body and arranged in spaced facing relation to said armature to define a variable-length first working air gap therebetween, having a second polepiece terminating in a second pole face arranged substantially perpendicular to said body surface and arranged in spaced facing relation to said armature to define a variable-length second working air gap therebetween, and having a third polepiece terminating in a third pole face arranged substantially perpendicular to said first and second pole faces and arranged in spaced facing relation to said armature to define a fixed-length non-working air gap therebetween, a coil surrounding said third polepiece, magnet means arranged in series with said first and second polepieces to oppositely polarize said first and second pole faces, and armature output motion means associated with said armature, the improvement which comprises:

flexure beam means for constraining said armature to move in an arcuate path in a predetermined plane.

12. The improvement as set forth in claim 11 wherein said flexure beam means includes a lever, wherein a tube sealingly surrounds said lever via a resilient fluid seal, and wherein the center of said arcuate path is positioned to allow a rocking motion of said lever.

13. The improvement as set forth in claim 11 wherein said flexure beam means includes two flexure beams connected between said armature and said body in a plane substantially perpendicular to said predetermined plane.

14. In a force motor adapted to be mounted on a surface of a body, having an armature mounted for movement relative to said body along a line substantially parallel to said surface, having a rigid magnetic structure, said structure having a first polepiece terminating in a first pole face arranged substantially perpendicular to said body surface and arranged in spaced facing relation to said armature to define a variable-length first working air gap therebetween, having a second polepiece terminating in a second pole face arranged substantially perpendicular to said body surface and arranged in spaced facing relation to said armature to define a variable-length second working air gap therebetween, and having a third polepiece terminating in a third pole face arranged substantially perpendicular to said first and second pole faces and arranged in spaced facing relation to said armature to define a fixed-length non-working air gap therebetween, a coil surrounding said third polepiece, and magnet means arranged in series with said first and second polepieces to oppositely polarize said first and second pole faces, the improvement which comprises:

clamping means operatively arranged between said structure and body for selectively permitting said structure to be slidably moved along said surface to adjust the length of at least one of said first and second working air gaps;

adjustment means for enabling the position of said third polepiece with respect to said armature to be adjusted so as to adjustably set the length of said non-working air gap; and flexure beam means for constraining said armature to move in an arcuate path in a predetermined plane.

* * * * *